US006075320A

United States Patent [19]

Winsor

[11] Patent Number: 6,075,320

[45] Date of Patent: Jun. 13, 2000

[54] WIDE ILLUMINATION RANGE FLUORESCENT LAMP

[75] Inventor: Mark D. Winsor, Seattle, Wash.

[73] Assignee: Winsor Corporation, Tumwater, Wash.

[21] Appl. No.: 09/017,262

[22] Filed: Feb. 2, 1998

[51] Int. Cl.[7] ..... H05B 37/00

[52] U.S. Cl. ..... 315/94; 313/493; 313/634

[58] Field of Search ..... 313/638, 639, 313/573, 574, 493, 494, 634; 315/169.3, 169.4, 94, 98, 106, 107, 160, 168, 167, 175

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |

(List continued on next page.)

FOREIGN PATENT DOCUMENTS

| | | |
|---|---|---|
| 0 066 495 A2 | 12/1982 | European Pat. Off. . |
| 0 329 226 A1 | 8/1989 | European Pat. Off. . |
| 0 550 047 A2 | 7/1993 | European Pat. Off. . |
| 89 04 853 U | 8/1989 | Germany . |
| 39 22 865 A1 | 1/1991 | Germany . |
| 43 13 017 A1 | 12/1994 | Germany . |
| 60216435 | 10/1985 | Japan . |
| 62208536 | 9/1987 | Japan . |
| 1017374 | 1/1989 | Japan . |
| 64-17374 | 1/1989 | Japan . |

(List continued on next page.)

OTHER PUBLICATIONS

Mercer et al., "Fluorescent backlights for LCDs," *Information Display*: Nov. 8–13, 1989.

Sanyo Electric Co., Ltd., "Flat Fluorescent Lamp Specifications."

Hinotani et al., "Flat Fluorescent Lamp for LCD Back–Light," *1988 International Display Research Conference*.

*Primary Examiner*—David H. Vu

*Attorney, Agent, or Firm*—Seed IP Law Group

[57] ABSTRACT

A wide illumination range fluorescent lamp is described. The lamp utilizes three discrete sets of electrodes positioned to generate electric field to produce light energy within three distinct ranges of light intensity. The electrodes include primary electrodes for creating a plasma arc discharge through the lamp, a secondary electrode along the interior walls of the lamp to produce electric fields along the discharge channel and a transparent cover electrode coupled with a base electrode to produce an electric field between the cover and the base of the lamp. Each of the three sets of electrodes operates within a different brightness range such that together the three electrodes provide illumination across a range from 0.1 foot-lamberts to 20,000 foot-lamberts. In an alternative embodiment of the invention, the primary electrodes are housed within secondary housings bonded to the base of the lamps such that the electrodes are concealed beneath the base of the lamp. In this embodiment, light is emitted from substantially the entire upper surface of the lamp.

28 Claims, 5 Drawing Sheets

U.S. PATENT DOCUMENTS

| | | | |
|---|---|---|---|
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,837,519 | 6/1989 | Lopetrone et al. | 324/529 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Winsor | 315/169.4 |
| 5,343,116 | 8/1994 | Winsor | 313/493 |
| 5,420,481 | 5/1995 | McCanney | 315/291 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,616,989 | 4/1997 | Taillie et al. | 315/32 |
| 5,645,337 | 7/1997 | Gleckman | 362/29 |
| 5,818,164 | 10/1998 | Winsor | 313/493 |
| 5,841,230 | 11/1998 | Ikoma et al. | 313/506 |
| 5,850,122 | 12/1998 | Winsor | 313/493 |
| 5,903,095 | 5/1999 | Yoshida et al. | 313/485 |
| 5,903,096 | 5/1999 | Winsor | 313/493 |
| 5,914,560 | 6/1999 | Winsor | 313/493 |

FOREIGN PATENT DOCUMENTS

| | | |
|---|---|---|
| 1206553 | 8/1989 | Japan . |
| 2-72552 | 3/1990 | Japan . |
| 2-78147 | 3/1990 | Japan . |
| 3-46748 | 2/1991 | Japan . |
| 3-129659 | 6/1991 | Japan . |
| 3-222253 | 10/1991 | Japan . |
| 3-285249 | 12/1991 | Japan . |
| 4-95337 | 3/1992 | Japan . |
| 4-147554 | 5/1992 | Japan . |
| 06251876 | 9/1994 | Japan . |
| 947340 | 1/1964 | United Kingdom . |
| 2 032 681 | 5/1980 | United Kingdom . |
| 2 217 515 | 10/1989 | United Kingdom . |
| WO 87/04562 | 7/1987 | WIPO . |
| WO 92/02947 | 2/1992 | WIPO . |

WIDE ILLUMINATION RANGE FLUORESCENT LAMP

TECHNICAL FIELD

The present invention relates to planar fluorescent lamps, and more particularly, to planar fluorescent lamps having wide illumination ranges.

BACKGROUND OF THE INVENTION

Planar fluorescent lamps are useful in many applications, including backlights for displays, such as liquid crystal displays. A common weakness in such fluorescent lamps is their limited illumination range.

Some planar fluorescent lamps utilize an electric plasma arc discharge through a mercury vapor gas to produce ultraviolet energy in a process referred to as hot cathode operation. The ultraviolet energy strikes a fluorescent material which converts the ultraviolet energy to visible light. To produce the electric plasma arc discharge, such lamps typically require a substantial minimum energy input. If the lamps are driven below the minimum energy input, the electric plasma arc discharge may not be formed, or may be highly non-uniform. Moreover, the efficiencies of such lamps can be degraded substantially at low level operation. To improve uniformity and efficiency, such lamps typically must be driven well above their minimum energy input levels so that a continuous, uniform electric plasma arc discharge can be formed. At such high energy levels, the lamp emits a substantial amount of light, typically in a range exceeding 250 foot-lamberts.

While such light intensities may be useful in relatively high light applications, in some applications such a high level of light intensity can be detrimental. For example, when such high intensity fluorescent lamps are used to provide illumination for nighttime displays in aircraft, high levels of light make it difficult for pilots to view objects outside of the cockpit or to see dimly lit instruments within the cockpit. Consequently, it is often desirable to dim the lamps to levels well below 250 foot-lamberts. Often it is desirable to dim the lamps to levels well below 10 foot-lamberts.

To improve dimmability, a filter can be added to such lamps to block out some of the light. Such filtering can reduce the maximum light intensity of the lamps, rendering them ineffective in high ambient light environments.

Another approach to producing low level illumination is cold cathode operation of fluorescent lamps. In cold cathode operation, an electric potential capacitively coupled across a set of electrodes energizes ions in the lamp chamber and causes secondary electron emission from the electrodes. The ions and electrons transfer energy to mercury vapor in the lamp causing the mercury vapor to emit ultraviolet energy. Fluorescent material in the lamp converts the ultraviolet energy to visible light. Cold cathode lamps typically produce lower light levels than hot cathode lamps, because operating cold cathode lamps at extremely high voltages can produce high voltage gradients within the lamp causing breakdown of the electrodes.

SUMMARY OF THE INVENTION

A lamp having a wide illumination range is embodied in a planar fluorescent lamp having an insulative lamp body formed from a base and a plurality of sidewalls. A lamp cover overlays the lamp body and is attached to the lamp body such that the lamp cover and the lamp body define a chamber. A plurality of channel walls within the chamber define a serpentine channel with a pair of electrodes of the hot cathode type at opposite ends of the channel. A second pair of electrodes of the cold cathode type are spaced apart along the serpentine channel for emitting electrons in a first section of the serpentine channel intermediate the first pair of electrodes. The lamp also includes a third pair of electrodes of the cold cathode type with one of the electrodes in the third pair being a first cover electrode carried by the lamp cover. A second of the electrodes in the third pair is a base electrode carried by the base of the lamp body. The base and cover electrodes are positioned with a first portion of the serpentine channel therebetween, such that an electric field between the base and cover electrodes excites electrons and ions in a first portion of the serpentine channel between the base and cover.

The electrodes in the first pair of electrodes generate an electric plasma arc discharge along the serpentine channel. A mercury vapor within the chamber reacts to the electric plasma arc discharge and produces ultraviolet energy in response thereto. A fluorescent layer within the lamp produces visible light energy in response to the ultraviolet energy. The first pair of electrodes may be positioned within the chamber at opposite ends of the serpentine channel; or, the electrodes and the first pair of electrodes may be positioned within secondary housings bonded to a lower surface of the lamp body. The first pair of electrodes are used to produce light in a range from about 250 to 20,000 foot-lamberts.

The electrodes in the second pair of electrodes emit electrons through secondary electron emission along sections of the serpentine channel. The electrons emitted by the second pair of electrodes cause the mercury vapor to produce ultraviolet energy which is, in turn, converted to visible light energy by the fluorescent layer. The second pair of electrodes is generally used to produce light within a range of approximately 100 to 500 foot-lamberts.

The third pair of electrodes also emit electrons through secondary electron emission. These electrons travel perpendicularly to the serpentine channel and cause the mercury vapor to emit ultraviolet energy, which is converted to visible light energy by the fluorescent layer. The third pair of electrodes generate light typically within the range 0.01 to 150 foot-lamberts.

In one embodiment, the lamp includes a second cover electrode positioned over a second portion of the serpentine channel to allow the illumination to be selectively controlled in two portions of the serpentine channel. The cover electrodes may be carried on an upper surface of the lamp cover and insulated from the chamber by the lamp cover; or, the cover electrodes may be covered on the lower surface of the cover and insulated from the chamber by an insulative layer.

In the embodiment where the first pair of electrodes are within the secondary housings on the lower surface of the lamp body, plasma slots are formed between the secondary housings and the chamber to allow the electric plasma arc discharge to enter the chamber and travel through the serpentine channel.

The first pair of electrodes, second pair of electrodes and third pair of electrodes are connected to separate power supplies controlled by a microprocessor such that the microprocessor may selectively energize the electrodes to provide illumination within a continuous range from 0.01 to 20,000 foot-lamberts.

DETAILED DESCRIPTION OF THE INVENTION

Figure 1:
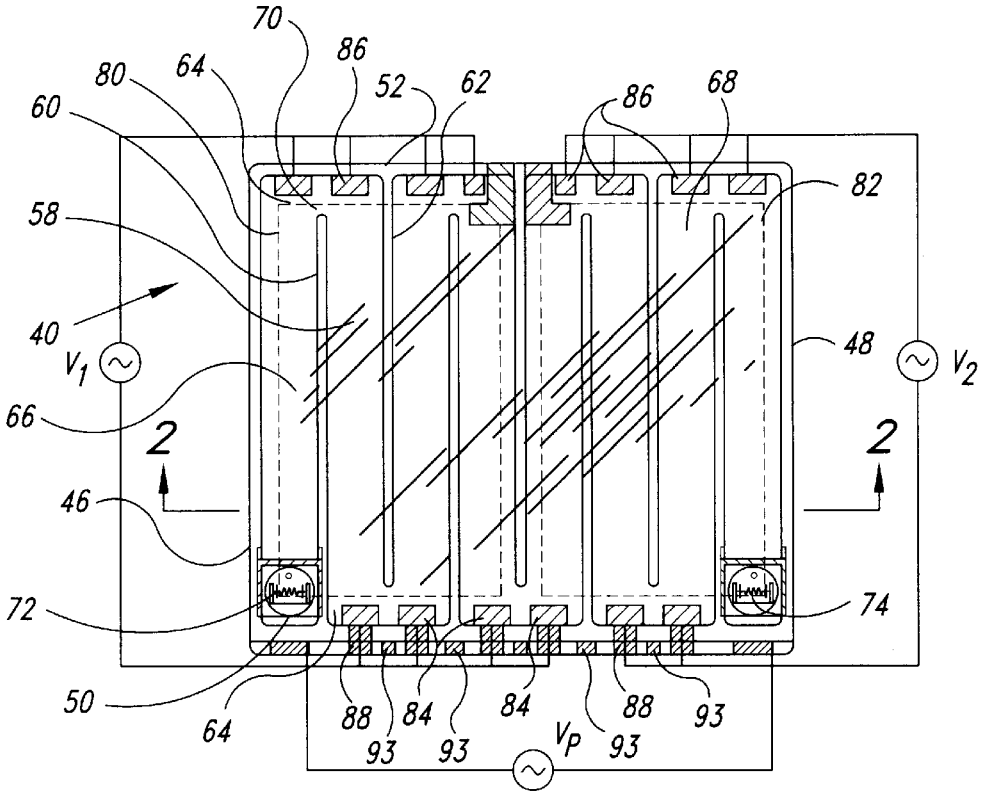
FIG. 1 is a top plan view of a lamp according to the invention having transparent planar cover ectrodes shown in broken lines and sidewall electrodes.
Figure 2:
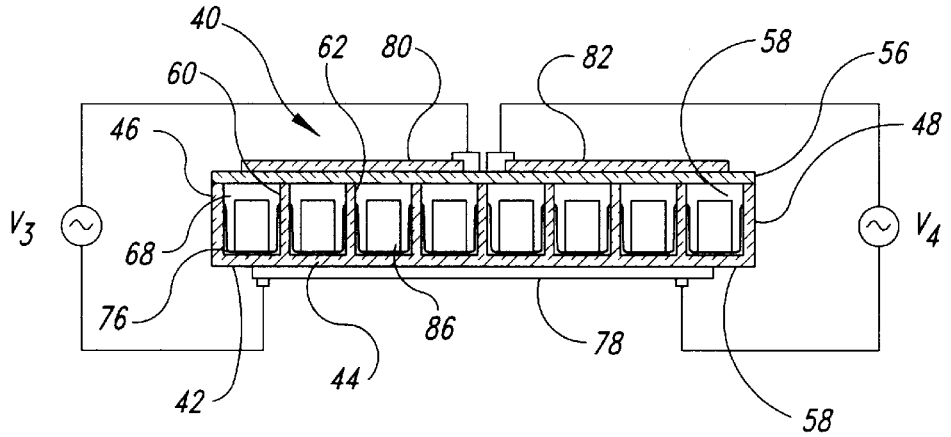
FIG. 2 is a side cross-sectional view of the lamp of FIG. 1 along the line 2—2.

A planar fluorescent lamp 40, shown in FIGS. 1–4, includes a lamp body 42 of a transparent glass. The lamp body 40 is formed from a base 44 having first and second sidewalls 46, 48 and first and second endwalls 50, 52 projecting upwardly therefrom to form a recess. A transparent lamp cover 56 overlays the recess and is bonded to the sidewalls 46, 48 and endwalls 50, 52 such that the lamp body 42 and cover 56 together form a sealed chamber 58.

Within the chamber 58, channel walls 60 project from the first endwall 50 toward the second endwall 52. The channel walls 60 end a short distance from the second endwall 52 forming gaps 64 between the distal ends of the channel walls and the second endwall. A complementary set of channel walls 62 extend from the second endwall 52 toward the first endwall 50 and form similar gaps 64 at their distal ends. The channel walls 60, 62 are spaced apart at equal intervals intermediate the first sidewall 46 and the second sidewall 48 to define a serpentine channel 66 having eight channel sections 68. Each of the channel sections 68 is connected to its adjacent channel sections 68 by the gaps 64 to define turns 70 in the serpentine channel 66. The channel walls 60, 62 are glass walls integral to the lamp body 42 and project upwardly from the base 44 toward the cover 56.

The channel walls 60, 62 are bonded to the lamp cover 56 by a clear glass solder such that the channel walls 60, 62 provide insulative barriers between adjacent channel sections. First and second primary electrodes 72, 74 of the hot cathode type are positioned at opposite ends of the serpentine channel 66. The primary electrodes 72, 74, upon electrical excitation by a power supply $V_P$, produce an electric plasma arc discharge (arrow 73 of FIGS. 3 and 4) which travels along the serpentine channel 66 between the electrodes 72, 74.

A gas containing mercury vapor within the chamber reacts to the electric plasma arc discharge and produces ultraviolet energy in response thereto. The ultraviolet energy from the mercury vapor gas is converted to visible light energy by a fluorescent layer 76 which coats the interior of the recess, including the channel walls 60, 62. The visible light energy $L_P$ emitted by the fluorescent layer 76 is transmitted to an observer through the transparent lamp cover 56. The visible light energy $L_P$ caused by the plasma arc discharge is emitted in a range from about 250 to 20,000 foot-lamberts. While light in the preferred embodiment is transmitted through the transparent lamp cover 56, one skilled in the art will recognize that the lamp 40 can be "flipped". That is, the base 44 can be transparent so that the lamp 40 emits light through the base 44 rather than, or in addition to, the lamp cover 56.

In addition to the primary electrodes 72, 74, the lamp 40 also includes a second set of electrodes, including a base electrode 78 and first and second cover electrodes 80, 82 (shown in broken lines) positioned to produce electric fields $E_V$ (see FIG. 4) perpendicular to the base 58. The base electrode 78 is a thick film conductive layer patterned on the lower surface of the base in a known fashion. As discussed in greater detail below, the base electrode 78 may alternatively be positioned within the chamber 58. The base electrode 78 may also be formed according to other known fabrication techniques, such as thin film deposition. The first and second cover electrodes 80, 82 are formed from a patterned transparent conductive film deposited on the upper surface of the lamp cover 56. Because the cover electrodes 80, 82 are transparent they are represented in broken lines in FIG. 1. In the preferred embodiment, the transparent conductive film is an indium tin oxide (ITO) layer deposited according to conventional deposition techniques and patterned using conventional photolithographic techniques.

As best seen in FIG. 1, the first cover electrode 80 covers a first portion of the serpentine channel 66 and the second cover electrode 82 covers a second portion of the serpentine channel 66. The base electrode 78 underlays substantially the entire serpentine channel 66, such that the first cover electrode 80 is positioned directly above a first section of the base electrode 78 and the second cover electrode 82 is positioned directly above a second section of the base electrode 78.

Figure 3:
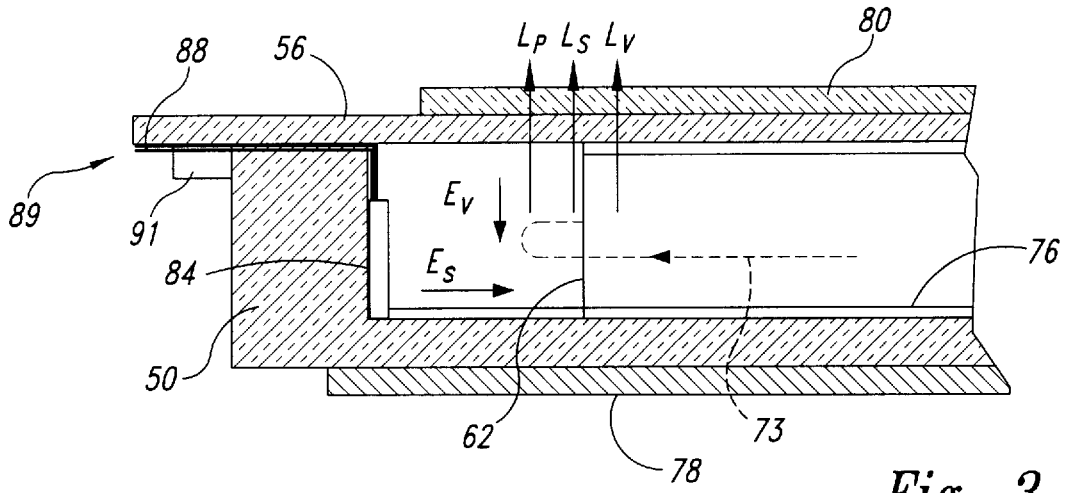
FIG. 3 is a detail cross-sectional view of a portion of the lamp of FIG. 1 showing electric fields near a turn.
Figure 4:
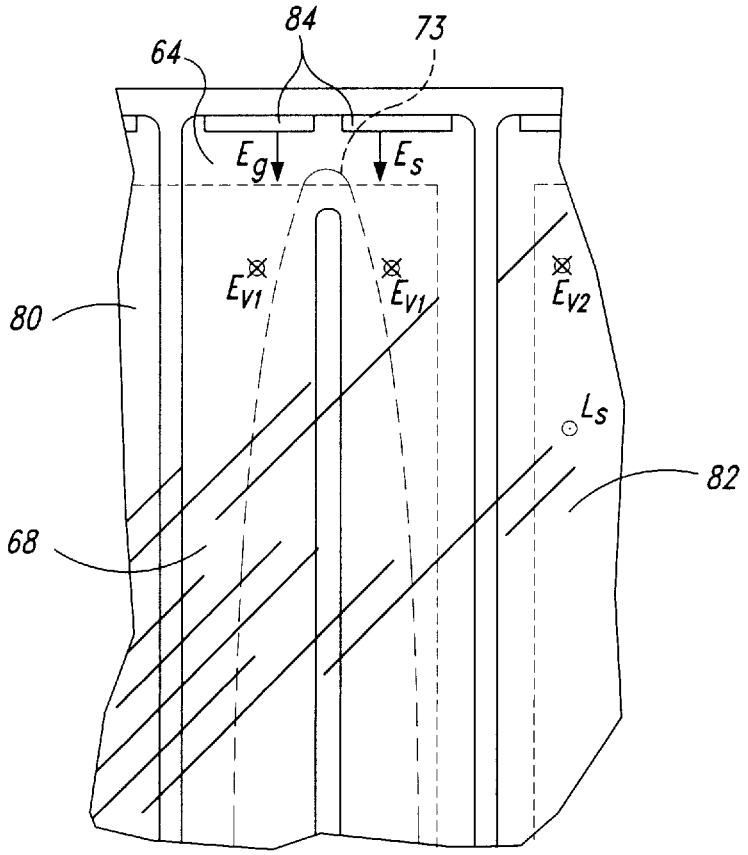
FIG. 4 is a top detail view of a portion of the lamp of FIG. 1 showing electric fields near a turn.

Each of the cover electrodes 80, 82 and the base electrode 78 includes a respective terminal for electrical connection thereto. Two power supplies $V_3$ and $V_4$ (FIG. 2) energize the cover electrodes 80, 82 and the base electrode 78. The power supply $V_3$ drives the first cover electrode 80 and the base electrode 78 to produce a vertical electrical field $E_{V1}$, as best seen in FIGS. 3 and 4. The power supply $V_4$ drives the second cover electrode 82 and the base electrode 78 to produce a corresponding electric field $E_{V2}$.

Because the base and cover electrodes 78, 80, 82 create a voltage differential independently of the electric plasma arc discharge they can produce light independently of the primary electrodes 72, 74, through cold cathode operation. Cold cathode operation results from the excitation, by the electrodes 78, 80, 82 of mercury vapor in the chamber 58 through electrons emitted by secondary electron emission and by collision with ions excited by the high electric field. The energy transferred to the mercury vapor causes the mercury vapor to emit ultraviolet energy upon its return to an unexcited state. The ultraviolet energy is then converted to visible light energy $L_V$ by the fluorescent layer 76.

Figure 5:
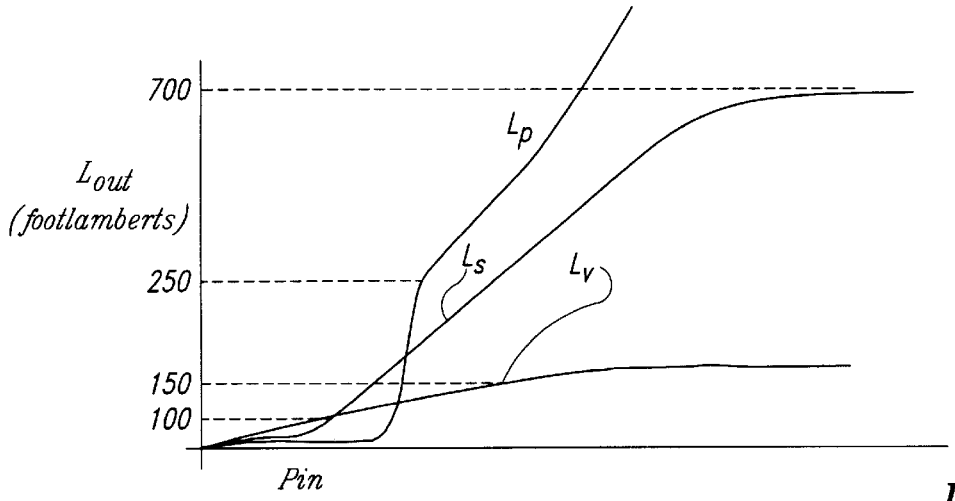
FIG. 5 is a graph of the light intensity versus input electrical energy for each of the electrode pairs of the lamp of FIG. 1.

Because the first and second cover electrodes 80, 82 are planar parallel electrodes that cover substantially the entire area of the serpentine channel 66, the light energy $L_V$ produced by secondary electron emission from the cover electrodes 80, 82 and base electrode 78 is emitted relatively uniformly throughout the entire lamp. As represented in FIG. 5, a 10.5" diagonal lamp produces the light energy $L_V$ relatively controllably in response to the electric field $E_V$ in a range from 0.01 to 150 foot-lamberts. This light level is most useful in very low ambient light conditions or in night vision systems.

In addition to the primary electrodes 72, 74 and the base and cover electrodes 78, 80, 82, the lamp 40 includes a first set of sidewall electrodes 84 positioned within the chamber along the first endwall 50 and a second set of sidewall electrodes 86 positioned along the second endwall 52. The sidewall electrodes 84, 86 are planar electrodes positioned adjacent the turns 70. The sidewall electrodes include corresponding sidewall terminals 88 to allow electrical connection to the sidewall electrodes 84, 86. The fabrication of sidewall electrodes in a planar fluorescent lamp is described in U.S. Pat. No. 5,343,116 which is incorporated herein by reference.

To facilitate connection to the sidewall terminals 88 and additional electrodes 72, 74, 78, 80, 82, the lamp 40 includes a card-edge connector 89. The card-edge connector 89 is formed by extending the lamp cover 56 beyond the sidewall 50. A supporting block 91 is bonded to the endwall 50 to support the extended lamp cover 56 for strength. As can be seen in FIG. 1, the card-edge connector 89 includes several conductive terminals 93 to allow electrical connection between the power supplies $V_P$, $V_1$, $V_2$, $V_3$, $V_4$ and their corresponding terminals, although the electrical connections are also represented schematically for completeness of presentation. For purposes of the discussion herein, the terminals associated with the electrodes 72 and 74 may be designated as primary terminals, the terminals associated with the electrodes 84 and 86 may be designated as secondary terminals, and the terminals associated with the electrodes 78, 80, and 82 may be designated as tertiary terminals. However, these labels are for convenience only and do not infer that one set of terminals are preferred over another set of terminals.

The sidewall electrodes 84, 86 are also used to provide illumination independently of the electrodes 72, 74 and the base and cover electrodes 78, 80, 82. As best seen in FIGS. 3 and 4, the sidewall electrodes 84, 86 can be energized to produce a voltage differential resulting in an electric field $E_S$ directed longitudinally along each of the channel sections 68.

As with the cover electrodes 80, 82 and the base electrode 78, the sidewall electrodes 84, 86 are operated as cold cathode electrodes to emit electrons along the sections of the serpentine channel 66 through secondary emission to produce ultraviolet energy. The ultraviolet energy from the mercury vapor is converted into visible light energy $L_S$ by the fluorescent layer 76. The light energy produced in response to an input electrical signal applied to the sidewall electrodes 84, 86 is shown in FIG. 5, as referenced to the light energy $L_P$ produced by the lamp due to electric plasma arc discharge. As can be seen from FIG. 5, light energy $L_S$ is produced by the sidewall electrodes 84, 86 in cold cathode operation at light levels lower than the level of the light energy $L_P$ produced by the electric plasma arc discharge and higher levels than the light energy $L_V$ produced by the base and cover electrodes 78, 80, 82. The sidewall electrodes 84, 86 thus provide a controllable, relatively uniform light in an intermediate range of around 100 to 700 foot-lamberts. This light level is most useful in low to intermediate level ambient light conditions, such as backlighting nighttime displays in a moderately lit cockpit.

Figure 6A:
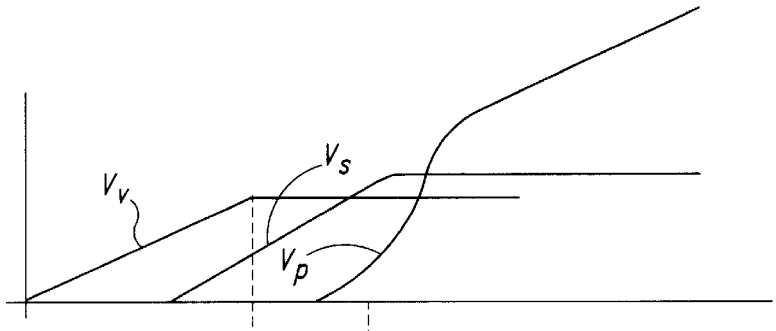
FIG. 6A is a voltage versus time graph for sequential energization of the electrodes.
Figure 6B:
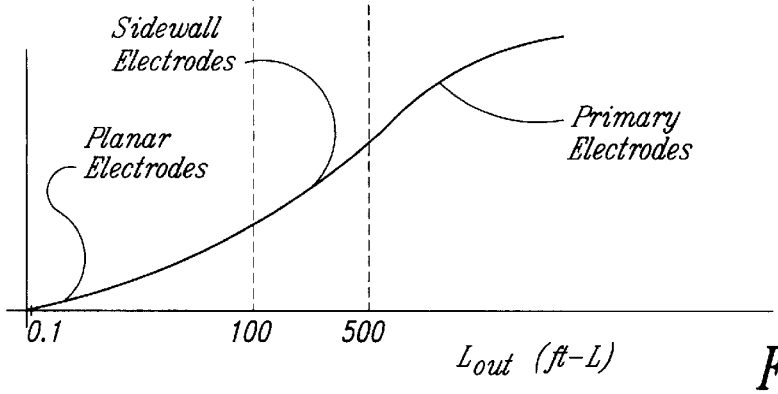
FIG. 6B is a light energy versus time response corresponding to the energization according to FIG. 6A.

Because the pair of primary electrodes 72, 74, the pair of sidewall electrodes 84, 86, and the combination of the base electrode 78 and the cover electrodes 80, 82 each produce light within a separate range of intensities, as seen by the graphs of FIGS. 6A and 6B, the lamp 40 may produce light throughout a range from about 0.01 to 20,000 foot-lamberts by selectively energizing the appropriate electrodes. For example, in very low light environments, the voltage $V_V$ drives the cover electrodes 80, 82 and the base electrode 78 to produce light energy $L_V$ in a range from about 0.01 FtL to about 100 FtL. In intermediate light environments, a voltage is applied to the sidewall electrodes 84, 86 to produce light energy $L_S$ from about 100–500 FtL. At such levels, the light energy $L_S$ from the sidewall electrodes may also be supplemented by the light $L_V$ from the cover electrodes 80, 82 and base electrode 78 to improve uniformity. In high light conditions, the voltage $V_P$ is supplied to the electrodes 72, 74 to produce light in a range from about 500–20,000 FtL. As discussed above, the light $L_P$ may be supplemented by light energy $L_V$ from the cover electrodes 80, 82 and base electrode 78, or may be supplemented by light from the sidewall electrodes 84, 86. The light energy $L_S$, is particularly beneficial at the lower portion of the range of light energy $L_P$ from the primary electrodes, because $L_V$ helps to "fill in" dark areas of the lamp 40, especially at corners in the serpentine channel 66 and regions away from the center of the channel, to provide a more uniform illumination.

Figure 7:
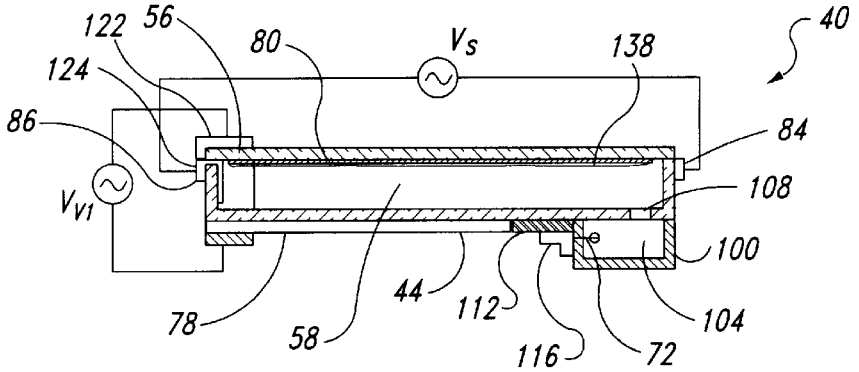
FIG. 7 is a side cross-sectional view of an embodiment of the lamp having secondary housings mounted to the lower surface of the lamp.
Figure 8:
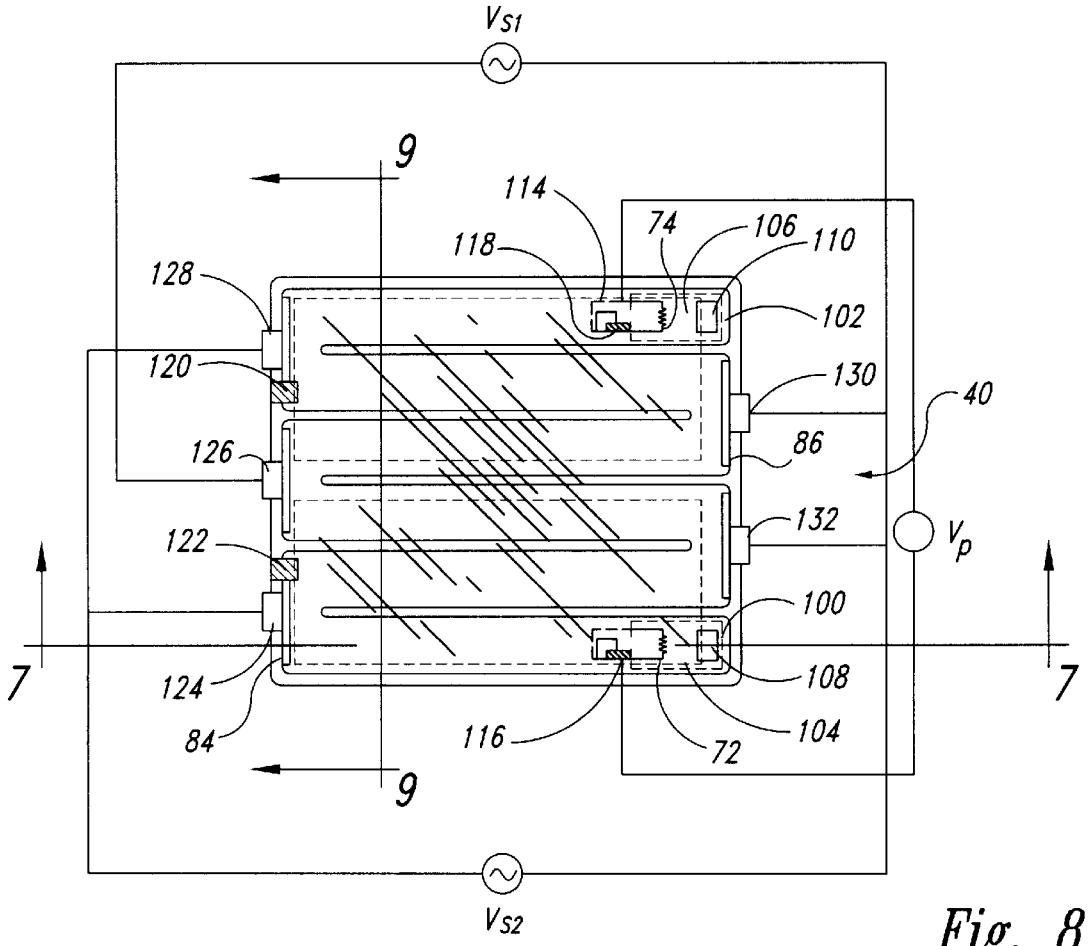
FIG. 8 is a top plan view of the lamp of FIG. 7 with the secondary housings and cover electrodes presented in broken lines.
Figure 9:
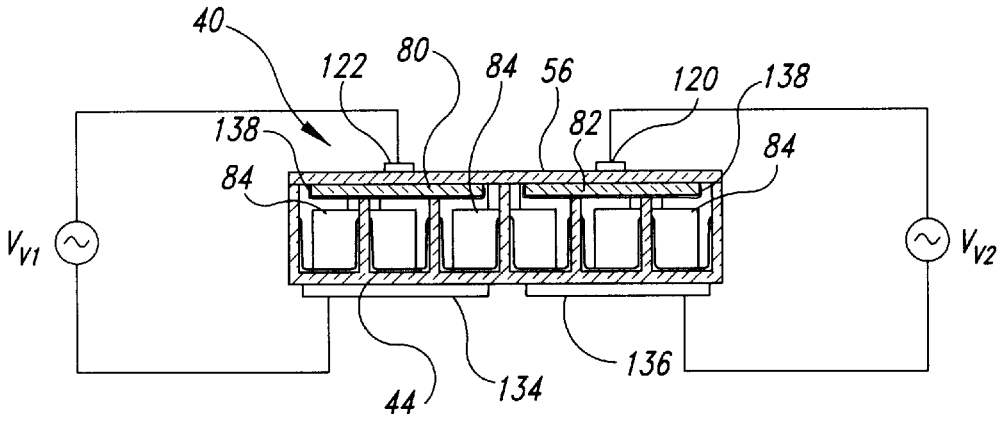
FIG. 9 is a side cross-sectional view of the lamp of FIG. 9 along the line 9—9 showing two separate base electrodes connected to separate power supplies.

A second embodiment of the lamp 40 is presented in FIGS. 7, 8 and 9 where the electrodes 72, 74 are housed within respective secondary housings 100, 102. The secondary housings 100, 102 are bonded to the base 44 to form electrode chambers 104, 106. The electrode chambers 104, 106 are coupled to the chamber 58 through plasma slots 108, 110. Because the secondary housings 100, 102 are mounted beneath the base 44, they are concealed as the lamp 40 is viewed from above the cover 56. As best seen in FIG. 7, the plasma arc must pass through the plasma slots 108, 110 and then along the serpentine channel 66. Consequently, the plasma arc passes directly above the electrodes 108, 110 causing ultraviolet and visible light emission in the chamber 58 between the electrodes 108, 110 and the lamp cover 56. This light emission largely eliminates dark regions of conventional lamps caused by electrical effects of the typical electrodes in lamp chambers.

To improve durability of the lamp 40 by minimizing protrusions, the electrodes 72, 74 are connected to respective printed circuit terminal boards 112, 114, which are bonded to the lower surface of the base 44. Connection between the electrodes 72, 74 and the corresponding terminal boards 112, 114 is through corresponding conductive ribbons 116, 118. To further maintain the lamp structure with no substantial protrusions, the base electrodes 78, the cover electrodes 80, 82, and the sidewall electrodes 84, 86 include similar ribbon terminals 120, 122, 124, 126, 128, 130, 132 which conform substantially to the outer surface of the lamp body 42 and the cover 56, respectively.

To further improve the durability of the lamp 40, the cover electrodes 80, 82 are formed on the underside of the cover 56. Because they are within the chamber 58, the cover electrodes 80, 82 are covered by a transparent insulative layer 158 to prevent the cover electrodes 80, 82 from forming a conductive "shortcut" between adjacent sections of the serpentine channel 66.

To allow the outermost channels of the lamp 40 to be controlled separately, the outermost sidewall electrodes 124, 128 are driven with a separate power source $V_{S2}$ from the power source $V_{S1}$ connected to the center sidewall electrode 126. This structure advantageously allows independent cold cathode operation at the center of the lamp 40 to supplement the plasma arc discharge at the lowest levels of hot cathode operation. Such cold cathode operation supplies light to "fill in" dark areas which commonly occur near the center of lamps at low levels of hot cathode operation.

As best seen in FIG. 9, the lamp 40 also includes two separate base electrodes 134, 136 positioned directly beneath the respective cover electrodes 80, 82 to allow each half of the lamp 40 to be controlled separately at low light levels. Each pair of base and cover electrodes 80, 134 and 82, 136 is connected to a separate power source $V_{V1}$, $V_{V2}$ to perit independent operation of the halves of the lamp. It will be understood that additional pairs of base and cover electrodes may be used to allow additional sections of the lamp to be controlled independently.

Figure 10:
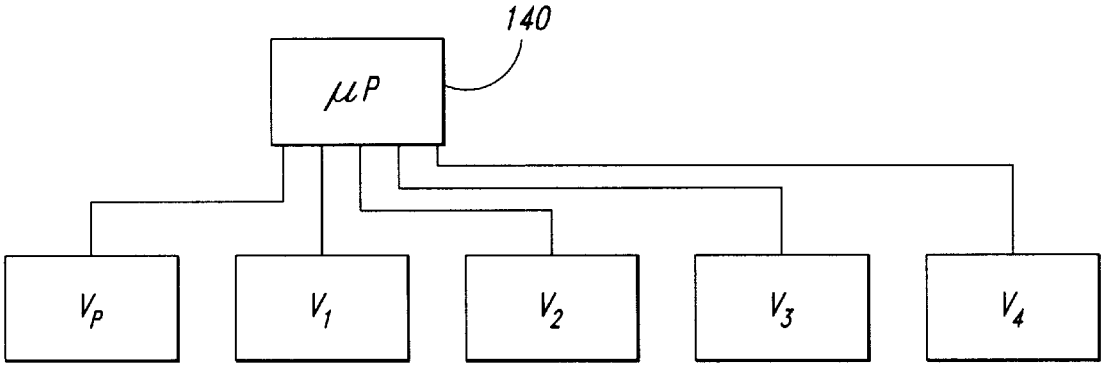
FIG. 10 is a diagrammatic representation showing microprocessor control of five power supplies for selectively energizing the electrodes of the lamp of FIG. 1.

Each of the power supplies described herein includes a digital control input to enable the output power to be selectively controlled. The power supplies are typically operated at differing frequencies, with the frequency of each power supply being selected such that there will be no interaction between the electrical responses of its respective electrodes and the electrical responses of the other electrodes. That is, the first power supply $V_1$ (see FIG. 1) operates at a first frequency, the second power supply $V_2$ operates at a second frequency and the third power supply $V_3$ operates at a third frequency. While interaction in the preferred embodiment is reduced by using different power supply frequencies, one skilled in the art will recognize a variety of approaches to reducing interaction. For example, the power supplies can be operated at the same frequency with predetermined phase shifts. For example, the first and second power supplies $V_1$ and $V_2$ can operate at the same frequency, but with the first power supply $V_1$ being phase shifted with respect to the second power supply $V_2$. Similarly, the second and third power supplies can operate at the same frequency, but with the second power supply $V_2$ being phase shifted with respect to the third power supply $V_3$. Alternatively, one or more of the power supplies can be operated at DC levels. As shown in FIG. 10, a microprocessor 140 is connected to separately control each of the power supplies $V_P$, $V_1$, $V_2$, $V_3$, $V_4$ connected to the lamp 40 of FIGS. 1–4. By transmitting the proper digital sequences to the power supplies, the microprocessor 140 can selectively energize the lamp 40 to emit light at any level between 0.01 and 20,000 foot-lamberts. The microprocessor 140 can thus be programmed to control the lamp 40 to adapt to a wide range of optical environments.

From the foregoing, it will be appreciated that, although embodiments of the invention have been described herein for purposes of illustration, various modifications may be made without deviating from the spirit and scope of the invention. For example a card edge connector or similar connection structure can be used in place of the ribbon terminals 120, 122, 124, 126, 128 for certain applications. Accordingly, the invention is not limited except as by the appended claims.

I claim:

1. A planar fluorescent lamp, comprising:

an insulative lamp body including a base having an upper surface and a lower surface, the lamp body further including a plurality of sidewalls connected to the base;

a lamp cover having a lower surface and an upper surface, the lamp cover being attached to the lamp body such that the lamp cover and lamp body define a chamber;

a plurality of channel walls within the chamber, the channel walls projecting from the base toward the cover, the channel walls, sidewalls, base and cover defining a serpentine channel having a first end and a second end and a plurality of turns therebetween;

a first pair of primary electrodes for producing an electric plasma arc discharge within the chamber, a first one of the primary electrodes being positioned at the first end and a second one of the primary electrodes being positioned at the second end;

a second pair of electrodes of the cold cathode type spaced apart along the serpentine channel for emitting electrons in a first section of the serpentine channel intermediate the first pair of primary electrodes; and a third pair of electrodes of the cold cathode type, including a first base electrode supported by the base and positioned beneath a first portion of the first section and a transparent first cover electrode supported by the cover, the first cover electrode being positioned above the first section of the serpentine channel.

2. The planar fluorescent lamp of claim 1 wherein the second pair of electrodes are located at opposite ends of a linear segment of the serpentine channel such that the first section is a substantially linear section.

3. The planar fluorescent lamp of claim 1 wherein the primary electrodes include a primary pair of terminals for electrical connection of a first electrical power source at a first frequency, each of the secondary electrodes includes a pair of terminals for electrical connection of a second electrical power source at a second frequency, and each of the tertiary electrodes include a pair of terminals for electrical connection of a third electrical power source at a third frequency.

4. The planar fluorescent lamp of claim 3 wherein the second frequency and third frequency are equal and the second electrical power source is phase shifted with respect to the third electrical power source.

5. The planar fluorescent lamp of claim 3 wherein the first frequency and second frequency are equal and the first electrical power source is phase shifted with respect to the second electrical power source.

6. The planar fluorescent lamp of claim 1, further including a second transparent cover electrode supported by the cover and spaced apart from the first transparent cover electrode, the second cover electrode being positioned above a second section of the serpentine channel and the first base electrode extends beneath the second section.

7. The planar fluorescent lamp of claim 6, further including a first pair of terminals for connection of a first electrical power source between the first cover electrode and the first base electrode; and a second pair of terminals for connection of a second power source between the second cover electrode and the first base electrode.

8. The planar fluorescent lamp of claim 7, further including a card-edge connector wherein the terminals in the first and second pairs are included in the card-edge connector.

9. The planar fluorescent lamp of claim 1, further including:

a second base electrode supported by the base and positioned beneath a second section of the serpentine channel; and a second cover electrode supported by the cover and spaced apart from the first cover electrode, the second cover electrode being positioned above the second section of the serpentine channel.

10. The planar fluorescent lamp of claim 1, further including a card-edge connector for connecting the first, second and third pairs of electrodes.

11. A planar fluorescent lamp, comprising:

an insulative lamp body having a planar base and a plurality of sidewalls connected to the base and projecting upwardly from the base;

a lamp cover having a lower surface and attached to the lamp body, the cover and lamp body defining a sealed chamber;

a first pair of electrodes positioned to produce a plasma arc discharge within the chamber, each of the electrodes in the first pair having a respective terminal for connection to a first power source;

a second pair of electrodes for producing secondary electron emission, the second pair being positioned to produce electron flow within the chamber parallel to the base, each of the electrodes in the second pair having a respective terminal for connection to a second power source;

a third pair of electrodes for producing secondary electron emission, the third pair of electrodes being positioned to produce electron flow within the chamber perpendicular to the electron flow produced by the second pair of electrodes, each of the electrodes in the third pair having a respective terminal for connection to a third power source;

a gas containing mercury vapor within the chamber for producing ultraviolet energy in response to the electric plasma arc discharge, the electron parallel to the base of the electron flow perpendicular to the base; and a fluorescent layer positioned to receive the ultraviolet energy, the fluorescent layer being responsive to emit visible light energy in response to the received ultraviolet energy.

12. The lamp of claim 11 wherein the third pair of electrodes includes:

a first transparent cover electrode supported by the cover and positioned above a first portion of the chamber; and a first base electrode supported by the base and positioned beneath the first portion of the chamber.

13. The lamp of claim 12, further including:

a fourth pair of electrodes for producing secondary electron emission, the fourth pair of electrodes including a second transparent cover electrode supported by the cover and positioned above a second portion of the chamber and a second base electrode supported by the base and positioned beneath the second portion of the chamber.

14. The lamp of claim 12 wherein the first cover electrode is positioned on the lower surface of the cover further including an insulative layer overlaying the first cover electrode to electrically insulate the first cover electrode from the chamber.

15. The lamp of claim 11, further including a channel wall extending from a first one of the sidewalls toward a second one of the sidewalls intermediate the first electrode and the second electrode of the first pair of electrodes to provide a barrier to prevent the electric plasma arc discharge from traveling directly from the first electrode to the second electrode.

16. The lamp of claim 11, further including:

a first secondary housing supported by the lamp body and having a recess therein, the first secondary housing abutting the lamp body to form a first secondary chamber, wherein the first electrode is positioned within the first secondary chamber and the lamp body includes a first plasma slot to permit the electric plasma arc discharge to communicate between the sealed chamber and the first secondary chamber.

17. The lamp of claim 16, further including:

a second secondary housing supported by the lamp body and having a recess therein, the second secondary housing abutting the lamp body to form a second secondary chamber, wherein the second electrode is positioned within the second secondary chamber and the lamp body includes a second plasma slot to permit the electric plasma arc discharge to communicate between the sealed chamber and the second secondary chamber.

18. The lamp of claim 11, further including a card-edge connector for coupling to the second and third pairs of electrodes.

19. An illumination apparatus, comprising:

an insulative lamp body including a base having an upper surface and a lower surface, the lamp body further including a plurality of sidewalls connected to the base;

a lamp cover having a lower surface and an upper surface, the cover being attached to the lamp body such that the cover and lamp body define a chamber; and a plurality of channel walls within the chamber, the channel walls projecting from the base toward the cover, the channel walls, sidewalls, base and cover defining a serpentine channel having a first end and a second end and a plurality of turns therebetween;

a pair of primary electrodes for producing an electric plasma arc discharge within the chamber, a first one of the primary electrodes being positioned at the first end and a second one of the primary electrodes being positioned at the second end, each of the primary electrodes including a primary of terminal;

a first electrical power source at a first frequency connected to the pair of primary electrodes to provide electrical energy to the primary electrodes;

a pair of sidewall electrodes, a first of the sidewall electrodes being positioned adjacent a first one of the turns and a second one of the sidewall electrodes being positioned adjacent a second one of the turns, each of the sidewall electrodes including a secondary terminal;

a second electrical power source at a second frequency connected to the secondary terminals to provide electrical energy to the sidewall electrodes;

a pair of vertical electrodes including a base electrode supported by the base and positioned beneath a portion of the serpentine channel and a transparent first cover electrode supported by the cover, a section of the first cover electrode being positioned above the portion of the serpentine channel, the first cover electrode being positioned relative to the base electrode such that, upon a voltage being applied between the first cover electrode and the base electrode, a predetermined electric field is formed within the portion of the serpentine channel intermediate the base electrode and the first cover electrode, each of the vertical electrodes including a tertiary terminal; and a third electrical power source at a third frequency connected to the tertiary terminals to provide electrical energy to the vertical electrodes.

20. The illumination apparatus of claim 19 wherein the first frequency is different from the second frequency.

21. The illumination apparatus of claim 20 wherein the first frequency is substantially zero such that the primary electrodes are operated as direct current (DC) electrodes.

22. The illumination apparatus of claim 20 wherein the third frequency is different from the first and second frequencies.

23. The illumination apparatus of claim 19 wherein the first frequency and second frequency are substantially equal and wherein the first power source is phase shifted with respect to the second power source.

24. The illumination apparatus of claim 19, further including a transparent second cover electrode spaced apart from the first cover electrode supported by the cover, a section of the second cover electrode being positioned above the portion of serpentine channel.

25. The illumination apparatus of claim 19 wherein the first cover electrode is positioned on the lower surface of the cover further including an insulative layer overlaying the first cover electrode to electrically insulate the cover electrode from the chamber.

26. A method of producing illumination over a predetermined intensity range having a lower portion, an intermediate portion and an upper portion, the lower portion including light intensities below a first intensity, the upper portion including light intensities greater than a second intensity greater than the first intensity and the intermediate portion including light intensities between the first intensity and the second intensity with a planar fluorescent lamp having a chamber containing a gas for producing ultraviolet energy in response to an input signal and a fluorescent material for producing visible light in response to the ultraviolet energy, comprising the steps of:

positioning a first pair of electrodes to provide electrical energy to the gas;

providing to the first pair of electrodes an electrical power input to cause the lamp to produce light within the upper portion of the intensity range;

positioning a second pair of electrodes to provide electrical energy to the gas providing to the second pair of electrodes an electrical power input to cause the lamp to produce light within the intermediate portion of the predetermined intensity range;

positioning a third pair of electrodes to provide electrical energy to the gas; and providing to the third pair of electrodes an electrical power input to cause the lamp to produce light within the lower portion of the predetermined intensity range.

27. The method of claim 26 wherein the step of providing an electrical power input to the first pair of electrodes comprises supplying electrical power of a predetermined first voltage and frequency to cause an electric plasma arc discharge between a first one of the first pair of electrodes and a second one of the first pair of electrodes.

28. The method of claim 27 wherein the step of providing an electrical input to the second pair of electrodes comprises providing electrical power at a predetermined second voltage and frequency to cause cold cathode electron emission from a first one of the electrodes in the second pair of electrodes, such that electrons emitted by the first one of the electrodes in the second pair of electrodes form the electrical energy to the gas.

* * * * *